US005215190A

United States Patent [19]

Hoffpauir, Jr.

[11] Patent Number: 5,215,190

[45] Date of Patent: Jun. 1, 1993

[54] MULTIPLE KEY CONTAINER HOUSING WITH SELECTIVE KEY PROJECTION MEANS

[76] Inventor: Raymond Hoffpauir, Jr., 2613 Deaton St., Lake Charles, La. 70601

[21] Appl. No.: 885,196

[22] Filed: May 19, 1992

[51] Int. Cl.[5] ..... A45G 11/32

[52] U.S. Cl. ..... 206/37.2; 206/37.3; 206/37.4; 206/37.8; 70/456 R

[58] Field of Search ..... 70/456 R, 456 B; 206/37.3, 37.4, 37.8

[56] References Cited

U.S. PATENT DOCUMENTS

| | | | |
|---|---|---|---|
| 1,573,723 | 2/1926 | Long | 70/456 R |
| 2,076,895 | 4/1937 | Johnston . | |
| 2,306,970 | 12/1942 | Macpherson et al. . | |
| 2,517,500 | 8/1950 | Macpherson et al. . | |
| 2,546,413 | 3/1951 | Williams . | |
| 2,593,441 | 4/1952 | Hager et al. | 70/456 R |
| 2,602,320 | 7/1952 | Lane . | |
| 2,618,958 | 11/1952 | Goodson | 70/456 R |
| 2,789,613 | 4/1957 | Corsaw . | |
| 3,321,943 | 5/1967 | Reyes | 70/456 R |
| 3,354,678 | 11/1967 | Stifelman . | |
| 4,646,913 | 3/1987 | Wing et al. . | |

FOREIGN PATENT DOCUMENTS

| | | | |
|---|---|---|---|
| 551792 | 1/1958 | Canada | 206/37.2 |
| 3040666 | 5/1982 | Fed. Rep. of Germany | 70/459 |
| 1286400 | 8/1972 | United Kingdom | 70/456 R |

*Primary Examiner*—William I. Price

*Attorney, Agent, or Firm*—Jacobson, Price, Holman & Stern

[57] ABSTRACT

An open sided elongated and rigid key case is provided for receiving a plurality of laterally spaced apart longitudinally extending keys therein with the base ends of the keys supported from the case for pivotal movement of the keys between stored positions substantially totally contained within the case and exposed positions with the lock insert ends of the keys projecting outwardly of the case. The case includes retention structure engagable with the keys as they are swung from an extended position to a partially extended position for frictionally resisting angular displacement of the keys relative to the case and a lever system is provided whereby selected keys within the case may be shifted from their retracted or stored positions to at least partially extended positions from the exterior of the case.

6 Claims, 2 Drawing Sheets

MULTIPLE KEY CONTAINER HOUSING WITH SELECTIVE KEY PROJECTION MEANS

BACKGROUND OF THE INVENTION

1. FIELD OF THE INVENTION

This invention relates to a key case for containing a plurality of keys and wherein the base ends of the keys are pivotally mounted within one end of the elongated case for angular displacement between stored positions contained within the case and exposed positions with the opposite lock insert ends of the keys swung outwardly of one side of the key case, the key case including structure to frictionally resist angular displacement of the keys relative to the case when the keys are disposed between the stored positions thereof and predetermined partially exposed positions.

2. DESCRIPTION OF RELATED ART

Various different forms of key cases including some of general structural and operational features of the instant invention heretofore have been provided. Examples of these previously known forms of key cases are disclosed in U.S. Pat. Nos. 2,076,895, 2,306,970, 2,517,500, 2,546,413, 2,602,320, 2,789,613, 3,354,678 and 4,646,913. However, these previously known key cases do not include the overall combination of structural and operational features incorporated in the instant invention.

SUMMARY OF THE INVENTION

The key case of the instant invention is constructed in a manner to be comfortably cradled in the fingers of one hand and to support a plurality of keys therefrom in position enclosed within the case, but with the case including structure by which a selected key within the case maybe angularly displaced from a stored position toward a partially or fully exposed position.

The key case pivotally mounts a plurality of keys therefrom for movement between stored positions thereof and exposed positions thereof and the case includes structure by which the keys are frictionally retained in the stored positions and against angular displacement toward fully exposed positions until the keys have been displaced to partially exposed positions from which they maybe readily manually pivoted to the fully exposed positions and readily manually displaced back to fully stored positions.

The main object of this invention is to provide a key case for supporting a plurality of keys in stored position and yet with the key case having structure by which a selected key therein maybe displaced to at least a partially exposed position.

Another object of this invention is to provide a key case capable of supporting blade type keys of various configurations.

Still another object of this invention is to provide a key case which may be readily operated by one hand.

A further object of this invention is to provide a key case which is particularly well adapted for quick access to a door key or the like supported therefrom by utilizing only one hand.

A final object of this invention to be specifically enumerated herein is to provide a key case in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
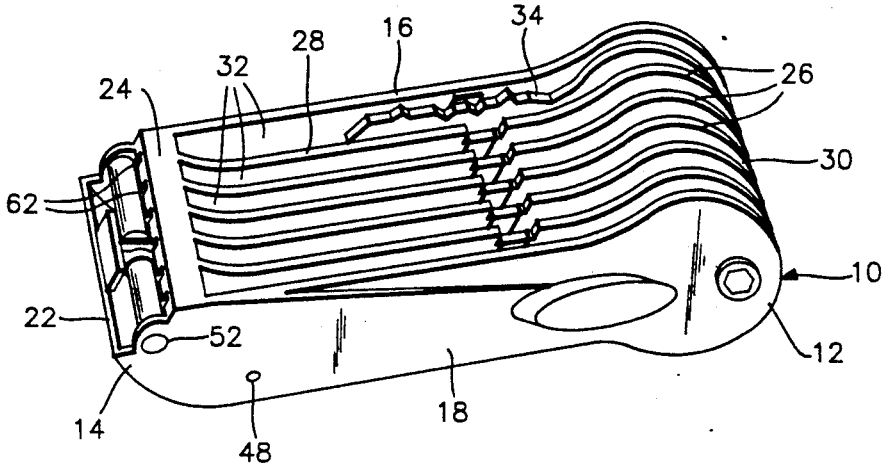
FIG. 1 is a perspective view of the key case with only a single key supported therefrom in order to more clearly illustrate the structure of the key case.

Referring now more specifically to the drawings the numeral 10 generally designates the key case of the instant invention. The case 10 is elongated and includes opposite ends 12 and 14 with a pair of opposite side longitudinal side walls 16 and 18 extending between the ends 12 and 14 and interconnected by a rear side wall 20 extending between the side wall 16 and 18. In addition, the end 14 includes an end wall 22 extending between the sides 16 and 18 as well as a transverse upper side brace 24. Also, the case 10 includes a plurality of upstanding longitudinally extending partitions 26 spaced apart between the side walls 16 and 8 and extending longitudinally of the case 10, the partitions 26 being formed. integrally with the brace 24 and the rear side wall 20, a slotted front wall 28 being defined between the sides 16 and 18 and the partitions 26. Also, because the partitions 26 extend fully to the end 12 which is otherwise open, the case 10 further defines a slotted end wall 30 remote from the end wall 22 and, further, the portion of the rear side wall 20 adjacent the end 12 is also slotted inasmuch as the wall 20 terminates a spaced distance from the end 12.

A longitudinally extending compartment 32 is defined between each pair of adjacent partitions 26 and between each side wall 16 and 18 and the adjacent partition 26. A key 34 is disposed in each compartment 32 and includes a lock insert end 35 and a base end 36. The base ends 36 are apertured as at 38 and disposed in the end 12 of the case 10 and the keys 34 extend longitudinally of the case from the end 12 toward the end 14.

Figure 2:
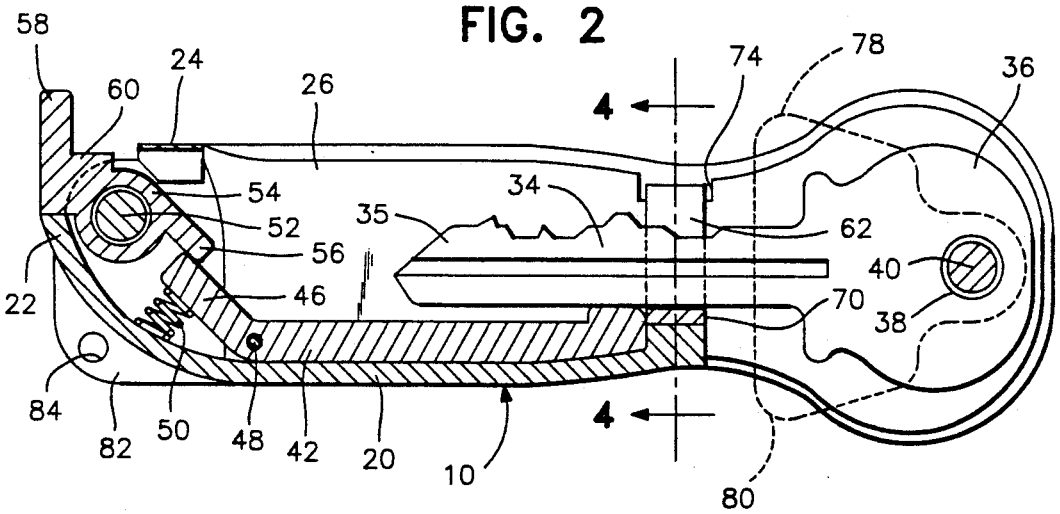
FIG. 2 is an enlarged fragmentary longitudinal vertical sectional view taken substantially upon a plane passing through the case immediately to the foreground of the key shown in the case in FIG. 1.
Figure 3:
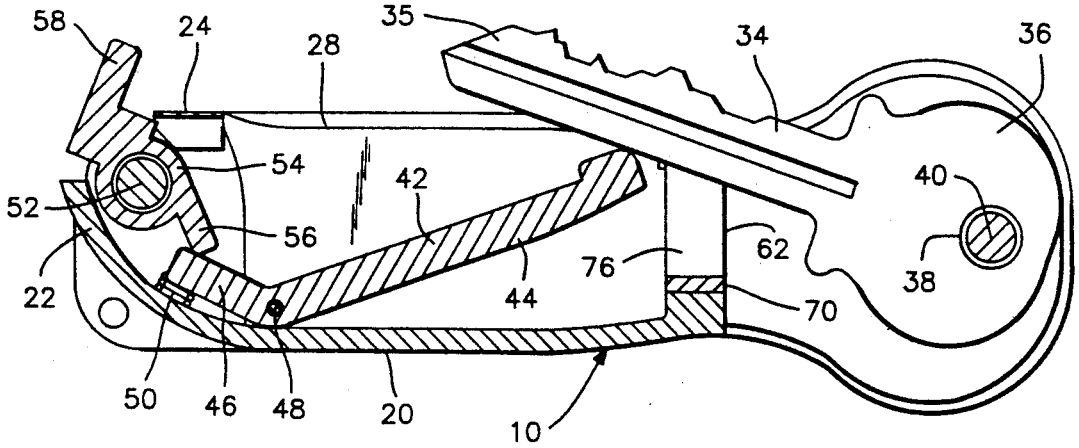
FIG. 3 is a longitudinal vertical sectional view similarly to FIG. 2 but illustrating the key ejection means operative to displace the key within the key case to a partially exposed position.

A removable pivot pin 40 is secured through the side walls 16 and 18 at the end 12 and pivotally supports the base end 36 of the key 34 therefrom for swinging movement of the key 34 from the stored position thereof illustrated in FIGS. 1 and 2 toward and past the partially exposed position thereof illustrated in FIG. 3 with the lock insert end 35 spaced outward of the slotted front wall 28.

A plurality of levers 42 including long and short arms 44 and 46 are disposed in the compartments 32 and pivotally supported from the case 10 through the utilization of a transverse pivot pin 48 secured through the side walls 16 and 18 and rotatably received through the levers 42 at the junctures of the long and short arms thereof.

The long arms 44 underlie the lock insert ends 35 of the keys 34 and the short arms 46 are inclined upwardly at generally 45 degrees beneath the transverse brace 24, coiled compression springs 50 being interposed between the short arms 46 and the end wall 22 in order to yieldingly bias the levers 42 toward the inactive positions thereof illustrated in FIG. 2.

A transverse pivot pin 5 also extends between the side walls 16 and 18 adjacent the end 14 and slidably and oscillatably supports a lever 54 thereon including first and second arms 56 and 58. The lever 54 further includes an upstanding index flange and the brace 24 includes index slots 62 spaced longitudinally therealong in which the index flange 60 may be selectively received.

Figure 4:
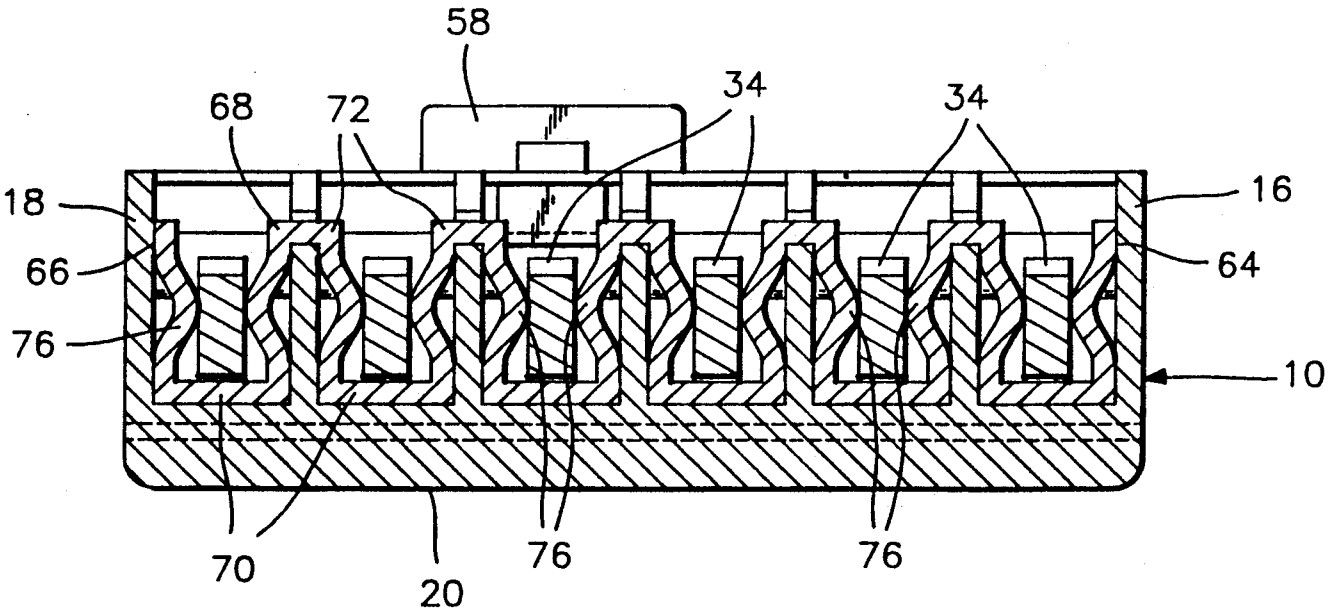
FIG. 4 is a transverse vertical sectional view taken substantially upon the plane indicated by the section line 4–4 of FIG. 2 and with each of the key receiving compartments of the case having a key disposed therein.

With attention now invited more specifically to FIGS. 1, 2 and 4 of the drawings, it may be seen that the case 10 includes a corrugated resilient strip 68 having its opposite ends secured to the inner surfaces of the side walls 16 and 18 at 64 and 66. The strip includes lower portions 70 spaced therealong which overlie the inner surface of the rear side wall 20, upper portions spaced therealong which pass through notches 74 formed in the partitions 26 and intermediate bowed portions 76 which extend between the lower and upper portions 70 and 72 and frictionally grip the adjacent portions of the keys 34 therebetween. Thus, the keys 34 are frictionally retained in their stored positions within the chambers 32.

When it is desired to use one of the keys 34, the lever is shifted longitudinally of the pivot pin 52 until such time as the index flange 60 is registered with the index slot 62 associated with the desired key. Then, the lever 54 is pivoted, by thumb or finger pressure, from the position thereof illustrated in FIG. 2 to the position thereof illustrated in FIG. 3 whereby the free end of the short arm 46 of the associated lever 42 will be swung downwardly and the free end of the long arm 44 will be swung upwardly and thereby upwardly displace the lock insert end 35 of the key 34 to the position thereof illustrated in FIG. 3. From this position, the free end of the user's thumb may be shifted to the right along the top of the case 10 as viewed in FIG. 3 and beneath the lock insert end 35 of the key 34 in order to further swing the key 34 to a fully exposed position. However, if the lever 54 is rapidly angularly displaced from the position thereof illustrated in FIG. 2 to the position thereof illustrated in FIG. 3, the lever arm 44 will "flip" the key 34 to a fully exposed position without the key 34 stopping in the partially exposed position illustrated in FIG. 3. When the key is positioned as illustrated in FIG. 3, the intermediate bowed portions 76 lightly grip the key 34 therebetween.

After usage of a key, the case 10, cradled in the fingers of one hand, may be rapidly moved in a manner to "flip" the key 34 back to at least the partially exposed position illustrated in FIG. 3, afterwhich thumb pressure may be applied to shift the key back to its fully stored position illustrated in FIG. 2.

Also, with attention invited to FIG. 2, some keys include enlarged base ends such as that illustrated at 78 in FIG. 2. If such keys are present in the case 10, upward finger pressure at 80 is sufficient to cause such a key to be shifted to a partially exposed position such as that illustrated in FIG. 3 of the drawings and the levers 42 and 54 need not be used in order to gain access to such a key.

The end 14 of the case 10 includes an outstanding lug 82 which is apertured at 84 in order to receive an attaching ring (not shown) or the like. Such an attaching ring may be utilized to attach the case 10 to a key case support, and further may be used to temporarily receive therethrough the tip of the little finger of a person cradling the key case in the fingers of one hand. In this manner, the case 10 may be anchored relative to the little finger, the case may be supported by the first, second and third fingers and the lever 54 may be manipulated by the thumb of the same hand. In addition, as the lever 54 is manipulated by the thumb of the hand, the first finger may be extended outwardly past and across the end 12 of the case 10 in order to act as an abutment for a key "snapped" from the case 10, immediately afterwhich the user's hand may be closed about the key case and his thumb may engage the exposed key on the side thereof remote from the user's first finger.

It is to be noted that the levers 42 and 54 together function as key ejection means for partially ejecting a key from a fully stored position within the case to at least a partially exposed position such as that illustrated in FIG. 3.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An elongated key case having opposite ends and including a first longitudinal side defined and extending between a pair of spaced apart and generally parallel other longitudinal sides, a plurality of generally elongated, parallel and laterally spaced apart keys including lock insert ends and remote base ends, pivot means pivotally mounting said keys in said case with said keys generally paralleling and disposed between said sides and for free angular displacement of said keys about an axis extending transversely of said case between corresponding ends of said other longitudinal sides adjacent one of said case ends between stored positions extending longitudinally of said case and exposed positions with said lock insert ends swung outwardly of said first side, said case including means operative to resist angular displacement of said keys relative to said case when said keys are disposed between said stored positions and predetermined partially exposed positions with said lock insert ends partially angularly displaced outward of said first side and inoperative to frictionally resist angular displacement of said keys when the latter are swung toward said exposed positions past said partially exposed positions, and manually operable key ejection means shiftably supported from said case for movement between operative and inoperative positions and operative to angularly displace a selected key from its stored position to at least substantially its partially exposed position, said key ejection means being slidably mounted upon an elongated support therefor extending transversely of the other case end for operational registry with an associated key and rockably disposed thereon with a portion thereof projecting outwardly of said first side and shiftable lengthwise of said case toward and away from said one case end between said operative and inoperative positions, respectively.

2. The key case of claim 1 wherein said pivot means pivotally mount said key base ends for at least 180 degrees angular displacement relative to said case from said stored positions with said lock insert ends projecting endwise outwardly of said one case end.

3. The key case of claim 1 including a lever pivotally supported from said case between said other longitudinal sides for each of said keys, said levers being operatively associated with the corresponding keys and shiftable between operative and inoperative positions, said levers each, when shifted from the inoperative position thereof to the operative position thereof, being operable to engage and angularly displace the associated key from its stored position to its partially exposed position, said key ejection means being selectively operatively associatable with said levers upon being shifted along said elongated support and engagable with the selected lever for movement thereof from the inoperative position to the operative position thereof upon rocking of said key ejection means from its inoperative position to its operative position.

4. The key case of claim 3 wherein said other end of said case includes an apertured anchor lug supported therefrom adapted to slidingly and pivotally support an anchor ring therefrom.

5. The key case of claims 1 wherein at least the portion of said second case side adjacent said one case end is open such that enlarged heads on the base ends of said keys may project from said second side for digital contact therewith and manual angular displacement of said keys to said partially exposed positions.

6. The key case of claim 1 wherein said key case includes laterally spaced apart elongated partitions extending longitudinally of said case between said longitudinal sides and between which partitions and longitudinal sides key receiving compartments are defined in which said keys are received when in said stored position, said partitions including longitudinal edges facing outwardly of said first side and transversely registered notches formed in said edges, said means operative to frictionally resist angular displacement of said keys including a corrugated resilient strip having opposite means secured to said longitudinal sides and lower and upper positions adjacent a second side of said case opposite said first side and passing through said notches, respectively, said strip including bowed portions extending between said lower and upper portions between which each stored key is frictionally retained.

* * * * *